US009111405B2

(12) United States Patent
Barragan et al.

(10) Patent No.: US 9,111,405 B2
(45) Date of Patent: Aug. 18, 2015

(54) PROTECTED COMMUNICATIONS VENDING MACHINE SYSTEM

(71) Applicants: Alfonso Barragan, Monterrey (MX); Herb Rose, Ashburn, VA (US); James Crow, Austin, TX (US)

(72) Inventors: Alfonso Barragan, Monterrey (MX); Herb Rose, Ashburn, VA (US); James Crow, Austin, TX (US)

(73) Assignee: Vendwatch Telematics, LLC, Austin, TX (US)

( * ) Notice: Subject to any disclaimer, the term of this patent is extended or adjusted under 35 U.S.C. 154(b) by 317 days.

(21) Appl. No.: 13/677,684

(22) Filed: Nov. 15, 2012

(65) Prior Publication Data

US 2014/0135980 A1 May 15, 2014

(51) Int. Cl.

| | |
|---|---|
| ***G07F 9/00*** | (2006.01) |
| ***G07F 9/02*** | (2006.01) |
| ***G07F 5/26*** | (2006.01) |
| ***G07C 9/00*** | (2006.01) |

(52) U.S. Cl.

CPC ..... *G07F 9/026* (2013.01); *G07C 9/00103* (2013.01); *G07F 5/26* (2013.01)

(58) Field of Classification Search

CPC ..... G07F 5/26; G07F 9/026; G07C 9/00103
See application file for complete search history.

(56) References Cited

U.S. PATENT DOCUMENTS

| | | | | |
|---|---|---|---|---|
| 4,927,051 | A * | 5/1990 | Falk et al. | 221/12 |
| 6,478,187 | B2 * | 11/2002 | Simson et al. | 221/75 |
| 7,167,892 | B2 * | 1/2007 | Defosse et al. | 700/237 |
| 7,821,395 | B2 * | 10/2010 | Denison et al. | 340/568.2 |
| 2004/0201449 | A1 | 10/2004 | Denison et al. | |

FOREIGN PATENT DOCUMENTS

| | | |
|---|---|---|
| JP | 05-159150 | 6/1993 |
| JP | 10-232964 | 9/1998 |
| JP | 2007-304949 | 11/2007 |
| KR | 10-0257931 | 6/2000 |

OTHER PUBLICATIONS

International Searching Authority, "Notification of Transmittal of the International Search Report and the Written Opinion of the International Searching Authority," mailed Feb. 26, 2014, in International application No. PCT/US2013/069798.

* cited by examiner

*Primary Examiner* — Timothy Waggoner
(74) *Attorney, Agent, or Firm* — Trop, Pruner & Hu, P.C.

(57) ABSTRACT

Vending Machines (VMs) employ a series of physical locks to prevent unauthorized access and/or control of the machine. In addition to the lock on the front door, in one embodiment of the invention an electrical door switch is employed that is used to enable a set of protected commands to the Vending Machine Controller Card (VMCC) only when the door has been opened. An electronic override of this switch, via remote control of a telemetry device (VIU) coupled to the VM, allows the VMCC to accept protected-mode commands from a central command server via a wireless network regardless of whether the door was actually opened. Other embodiments are described herein.

30 Claims, 7 Drawing Sheets

PROTECTED COMMUNICATIONS VENDING MACHINE SYSTEM

BACKGROUND

Due to the insecure environment of the typical deployed vending machine (VM) location, the VM employs a series of physical security measures to prevent intrusion and unauthorized access to the VM. The basic method of access control is by securing the front door of the machine through the use of a heavy duty lock and key with limited access to the keys. The basic concept is to keep unauthorized users from accessing operational equipment inside the VM, such as a controller card, and manipulating sales price, inventory totals, and the like.

BRIEF DESCRIPTION OF THE DRAWINGS

Features and advantages of embodiments of the present invention will become apparent from the appended claims, the following detailed description of one or more example embodiments, and the corresponding figures, in which:

DETAILED DESCRIPTION

Figure 1:
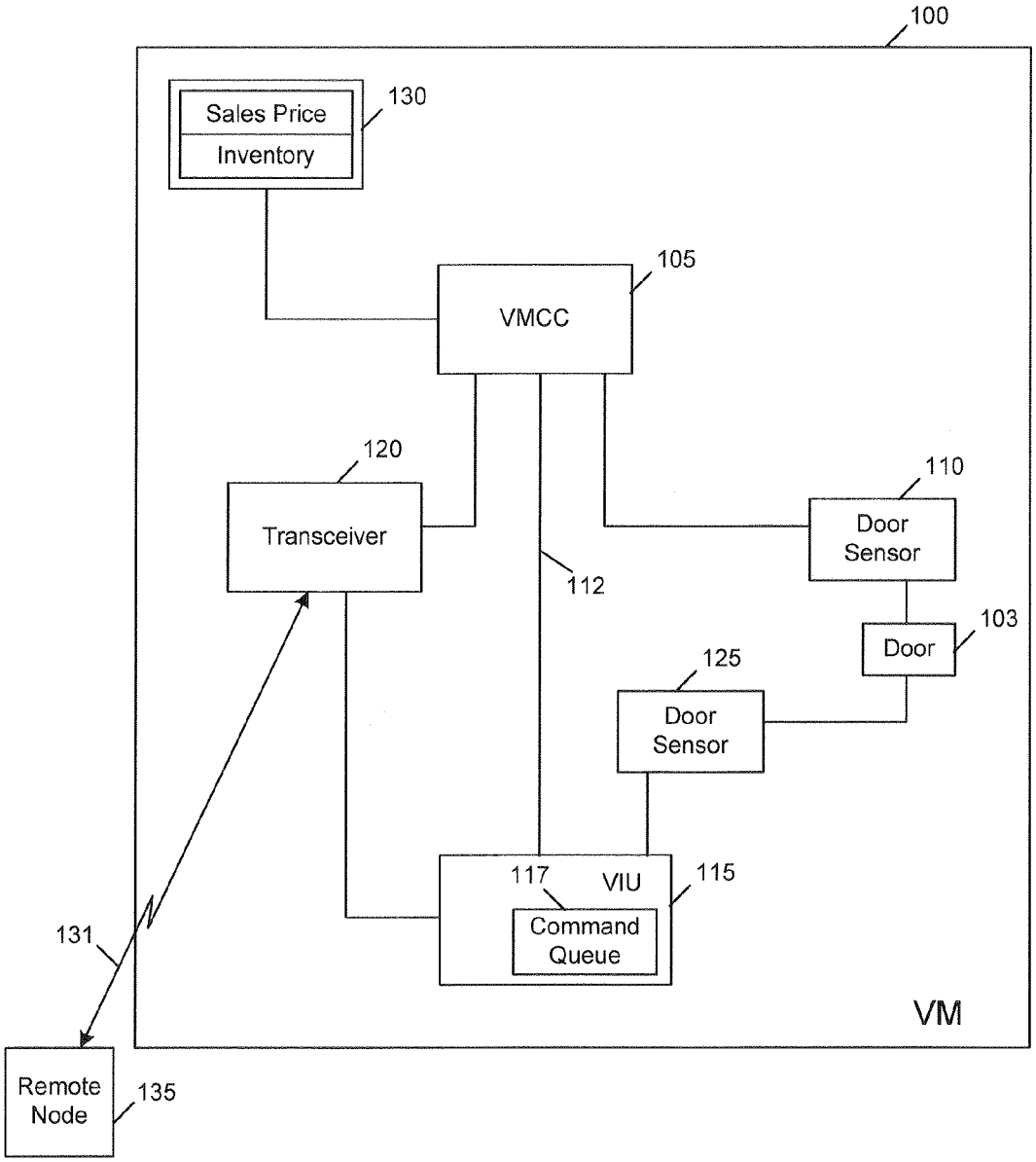
FIG. 1 includes a schematic representation of a protected communications VM in an embodiment of the invention.

In the following description, numerous specific details are set forth but embodiments of the invention may be practiced without these specific details. Well-known circuits, structures and techniques have not been shown in detail to avoid obscuring an understanding of this description. "An embodiment", "various embodiments" and the like indicate embodiment(s) so described may include particular features, structures, or characteristics, but not every embodiment necessarily includes the particular features, structures, or characteristics. Some embodiments may have some, all, or none of the features described for other embodiments. "First", "second", "third" and the like describe a common object and indicate different instances of like objects are being referred to. Such adjectives do not imply objects so described must be in a given sequence, either temporally, spatially, in ranking, or in any other manner. "Connected" may indicate elements are in direct physical or electrical contact with each other and "coupled" may indicate elements co-operate or interact with each other, but they may or may not be in direct physical or electrical contact. Also, while similar or same numbers may be used to designate same or similar parts in different figures, doing so does not mean all figures including similar or same numbers constitute a single or same embodiment.

At times herein descriptions cover several different figures at once. For clarity, figures include components where the most significant value denotes the figure that includes the component (e.g., element 3XX would be found in FIG. 3 and element 4XX would be found in FIG. 4).

As mentioned above, due to the insecure environment of the typical deployed VM location, the VM employs a series of physical security measures to prevent intrusion and unauthorized access to the machine. In addition to physical locks, in an embodiment the VM may have one or more sensors to monitor the open/closed state of the VM door. These sensor(s) may be used by electronic and electro-mechanical devices within the VM to allow access to a protected set of commands and features. In this manner, certain functions such as sales price, actuation of mechanical systems, electronic records of inventory, and the like are enabled only when the door has been opened by what is presumably an authorized person.

Using the above system of access control, a standard part of the route driver's or technician's visit to a VM is to open the door, thereby enabling the acceptance of protected mode commands, and then either through manual entry or through the use of a hand-held controller, make updates to the VM that are only possible using the protected-mode commands. This may be a slow and somewhat error prone process with the person entering commands one by one from a worksheet. It may also be a slow and constricted process due to the need for the technician's physical presence, as well as the manual entry programming of the VM via a handheld device such as a tablet, cell phone, personal digital assistant, Smartphone, Ultrabook, notebook, laptop, mobile communications node, and the like. In addition, this manual process prevents the ability to dynamically program/adjust the VM itself due to the need for an on-site visit to the VM to enable programming An embodiment leverages the inclusion of telemetry device(s) inside the VM with the ability to sense and control the door switch status to automate this manual process and convert it into an electronically monitored, centrally controlled activity. Furthermore, embodiments of the invention allow new and dynamic VM functionality/programming that enables, for example, variable pricing to match market demands, interactivity with the consumer, remote energy management and conservation, among other possibilities.

FIG. 1 includes a schematic representation of a protected communications VM in an embodiment of the invention. FIG. 1 pertains to a non-interrupt door switch mode. VM 100 includes door 103 coupled to door sensor 110 (a sensor, such as sensor 110, is at times addressed herein as a switch, which constitutes a form of sensor), which indicates to a processor controller, such as Vending Machine Controller Card (VMCC) 105, that door 103 is in an open state and/or closed state. A telemetry device, such as vending interface unit (VIU) 115 or other communications node that may interface with other nodes located outside VM 100, may store command queue 117 in memory within or coupled to VIU 115. This embodiment may retrofit older VMs that may include a preexisting door sensor/switch and VMCC circuit that should not (for technical or non-technical reasons) be altered or interrupted. In such an embodiment additional door sensor 125 is included in VM 100 and placed under direct or indirect control of VIU 115. Sensor 125 may exist in addition to door sensor 110 and may couple to an input/output (I/O) port of VIU 115, allowing VIU 115 to sense door state status (e.g., open, closed).

Figure 3:
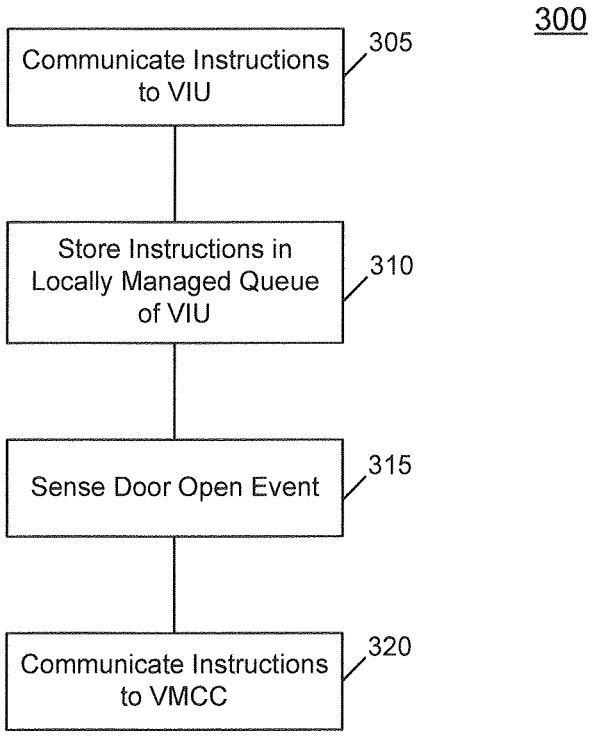
FIG. 3 includes a process flow in an embodiment of the invention.

In an embodiment, protected mode commands (e.g., commands that may only be communicated to VMCC 105 during an open door state) may be transferred to VIU 115 from remote node 135 (e.g., remotely located central server that couples to many other VMs, a Smartphone wirelessly coupled to transceiver 120, a tablet, laptop, mobile communications node, and the like) over the wireless or mesh network 131 and transceiver 120 (see also FIG. 3, block 305 for a flow chart describing an embodiment of a method for protected communications with the VM). VIU 115 stores the commands in a locally managed (or remotely managed) queue 117 (see also block 310). Upon future physical door open events (e.g., the next visit from a technician) VIU 115 senses (via sensor 125) this open door state through its sensor 125 (see also block 315) and then performs the sequence of protected-mode commands in command queue 117 (see also block 320) by communicating those commands to VMCC 105 (which is now receptive to such commands due to an open door state communicated to VMCC 105 from sensor 110) via interconnect (e.g., wire, trace) 112. Upon completion of communicating the commands or instructions, VIU 115 may produce a status report and communicate the report to node 135 indicating the execution of the commands (successful, complete, and the like) and any resulting output or status. The protected-mode commands/instructions (or instances of instructions derived there from) may be communicated to VMCC 105 via a pre-existing port (e.g., direct exchange (DEX) port connection) between VMCC 105 and VIU 115. In an embodiment, this process may take place automatically and may not require any initiation or attention from the technician during the visit (e.g., the technician opens the door and the commands are communicated with or without his or her knowledge). In an embodiment, a visual indication may be provided to show the automatic activity in progress such that the technician can ensure that his/her activities do not conflict with that of VIU 115.

Figure 2:
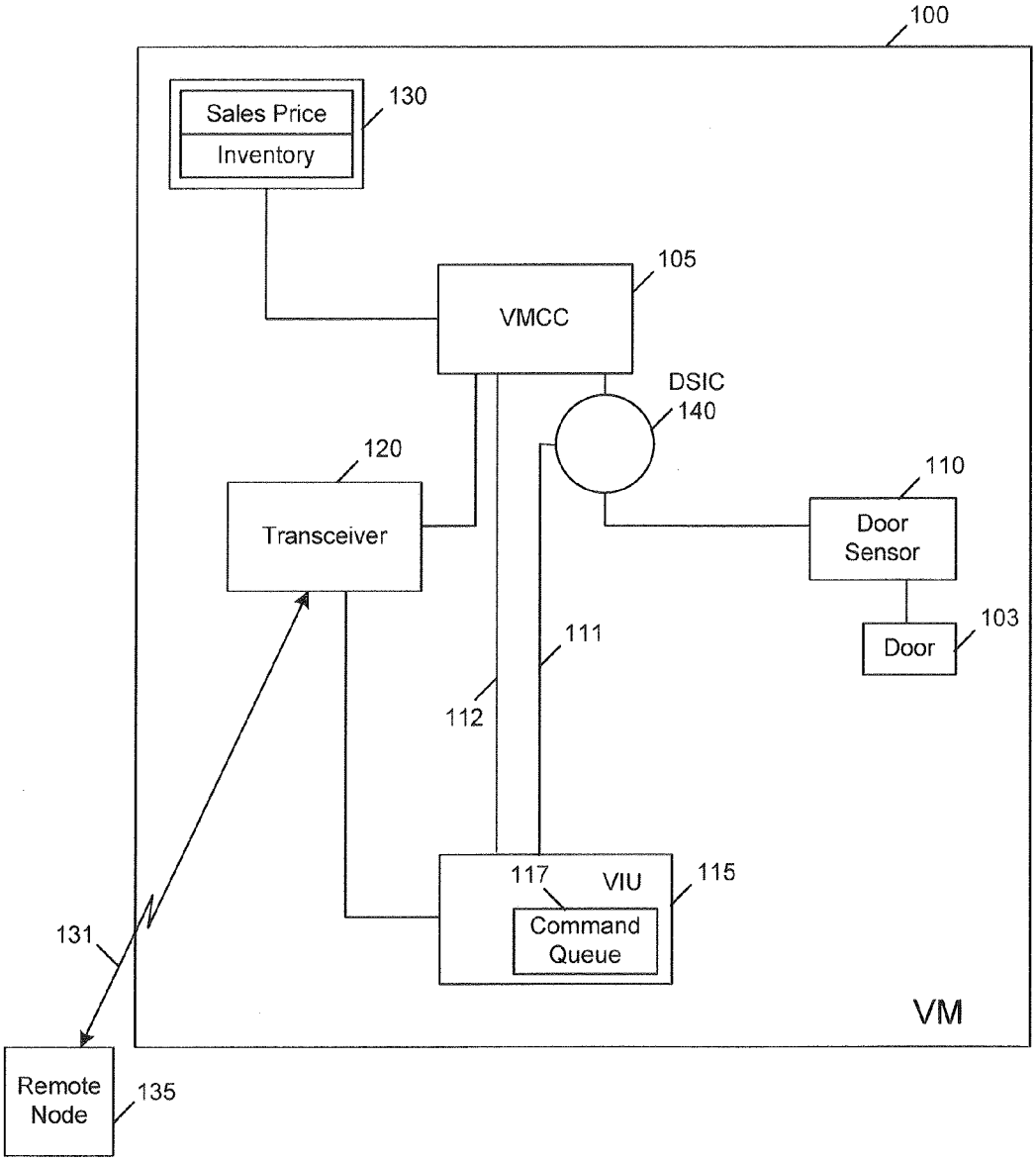
FIG. 2 includes a schematic representation of a protected communications VM in an embodiment of the invention.

FIG. 2 includes a schematic representation of a protected communications VM in an embodiment of the invention. FIG. 2 depicts an interrupted door switch mode whereby an electronic circuit allows for the interruption and "override" of the existing physical door sensor/switch within the VM. In one embodiment this occurs via an interrupt circuit (such as, for example, Door Switch Interrupter Circuit (DSIC) 140) that is adaptable to the conditions of a current or pre-existing VM door sensor (such as sensor 110 that is coupled to door 103). DSIC 140 allows for variances in voltages, and/or normally-open vs. normally-closed switch or sensor conditions so it can be inserted between existing door switch/sensor 110 and VMCC 105.

In an embodiment, DSIC 140 provides an electrically compatible switch status output that is coupled to a door sensor input of VMCC 105. This allows DSIC 140 to directly (or indirectly) drive door switch status (e.g., open, closed) to VMCC 105 regardless of the state of original door switch 110. In an embodiment, a connection from VIU 115 to switch 110 (e.g., an indirect connection or coupling between VIU 115 and switch 110 via DSIC 140) allows VIU 115 to sense the status of switch 110 (and, for example, communicate commands from VIU 115 to VMCC 105 upon detection of an open door state from switch 110). In an embodiment, a controlling input is used by VIU 115 to communicate desired door switch status to VMCC 105 (such as input 111 that couples to VMCC 105 via DSIC 140).

In an embodiment, DSIC 140 may be installed into VM 100 by terminating an existing two-wire door switch connection to sensor 110 and inserting the DISC in series between switch/sensor 110 and VMCC 105. Another connector from DSIC 140 may couple to VIU 115 (e.g., by interconnect 111), allowing the VIU to both sense the state of physical switch 110 and also define (e.g., override) the desired switch status that is sensed by VMCC.

In an embodiment, protected-mode commands may be initiated at any time and do not rely upon the need for a technician visit and an actual door open condition being sensed by sensor 110. Any desired commands (i.e., instructions, data, and the like) are communicated to VIU 115 from node 135 over a wireless or mesh network 131 along with, for example, time start, duration, and/or additional rules and details about how to deploy the commands.

Figure 4:
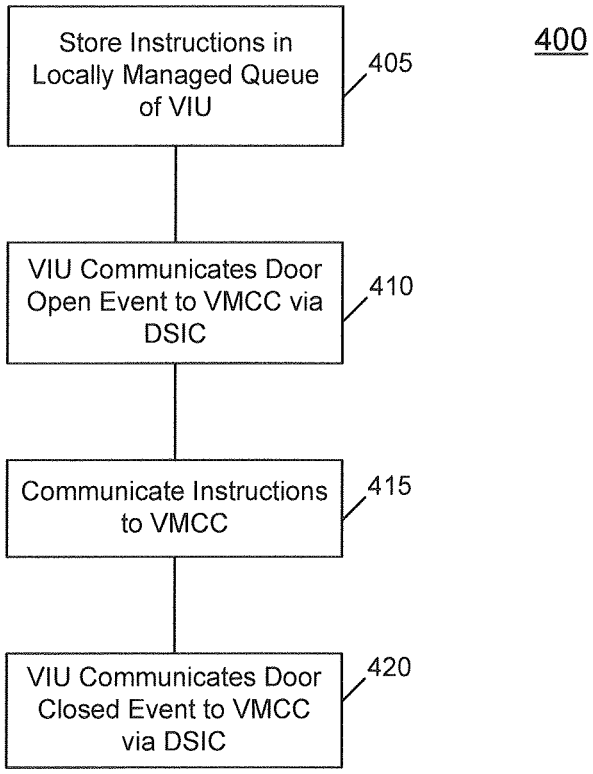
FIG. 4 includes a process flow in an embodiment of the invention.

In an embodiment, VIU 115 performs the following sequence of events to deploy a protected-mode command. As seen in FIG. 4, VIU 115 may include instructions in queue 117 (block 405). These instructions may have been received days, hours, minutes, or milliseconds prior to their conveyance to VMCC 105. VIU 115 drives a control input to DSIC 140 (block 410) and then to VMCC 105 such that VMCC 105 senses a "door open" status condition (regardless of whether door 103 is actually open). Queued protected-mode commands 117 within VIU 115 that meet deployment rules criteria (e.g., time of day, condition of current VM stock, and the like) are communicated to VMCC 105 via, in one embodiment, an existing DEX port connection of VMCC 105 (block 415), such as interconnect 112. In an embodiment, VIU 115 collects status (and/or any other results of the executed command(s)) into a status report. Upon completion of communication of a queued command (e.g., the last command), VIU 115 drives the DSIC control input to the state where VMCC 105 senses a door closed status (block 420) (regardless of whether the door was ever actually open). In an embodiment, VIU 115 then transfers the resulting status report across network 131, via transceiver 120 (or via wired means) to node 135.

Thus, in an embodiment multiple commands may be queued for rules-based dispatch and/or the immediate deployment of a single, high-priority command as needed. An embodiment allows a fully-interactive session between VMCC 105, VIU 115, and node 135 such that real-time status may be used to drive the desired sequence of protected-mode commands.

There are numerous applications enabled by embodiments of the invention. For example, an embodiment remotely defines and executes protected mode commands on the VMCC, which opens a wide spectrum of valuable dynamic VM behavior. The following examples are not limiting and include: (1) Remote/Dynamic Price Changes—the ability to change product sales prices based upon policy, time, or other condition; (2) Remote Remediation—the correction of pricing, stocking, the remote reset of VMCC peripheral devices or other errors that have been detected; (3) Free Sample Promotions—the ability to execute marketing promotions based upon discounted or even free product based upon remotely defined rules and policies; (4) Customer Service—the ability to address a complaint from a customer for a product that was paid but not dispensed through the immediate vend function; (5) Energy Conservation—the ability to control the VM compressor and/or other high energy consumption devices allowing a VM "hibernation mode" during low usage hours; (6) Remote Display Messaging—the ability to update consumer-facing display content dynamically from the central server based upon policy and rules; (7) Technician Audit—the ability to track actual visit time and duration of a technician or salesman to a machine; and/or (8) Fraud Detection—in combination with the battery-powered VIU device, the ability to detect a power outage followed by an unauthorized door-open.

Note that there may be additional methods of sensing and/or simulating door switch events through other hardware connection methods.

Figure 5:
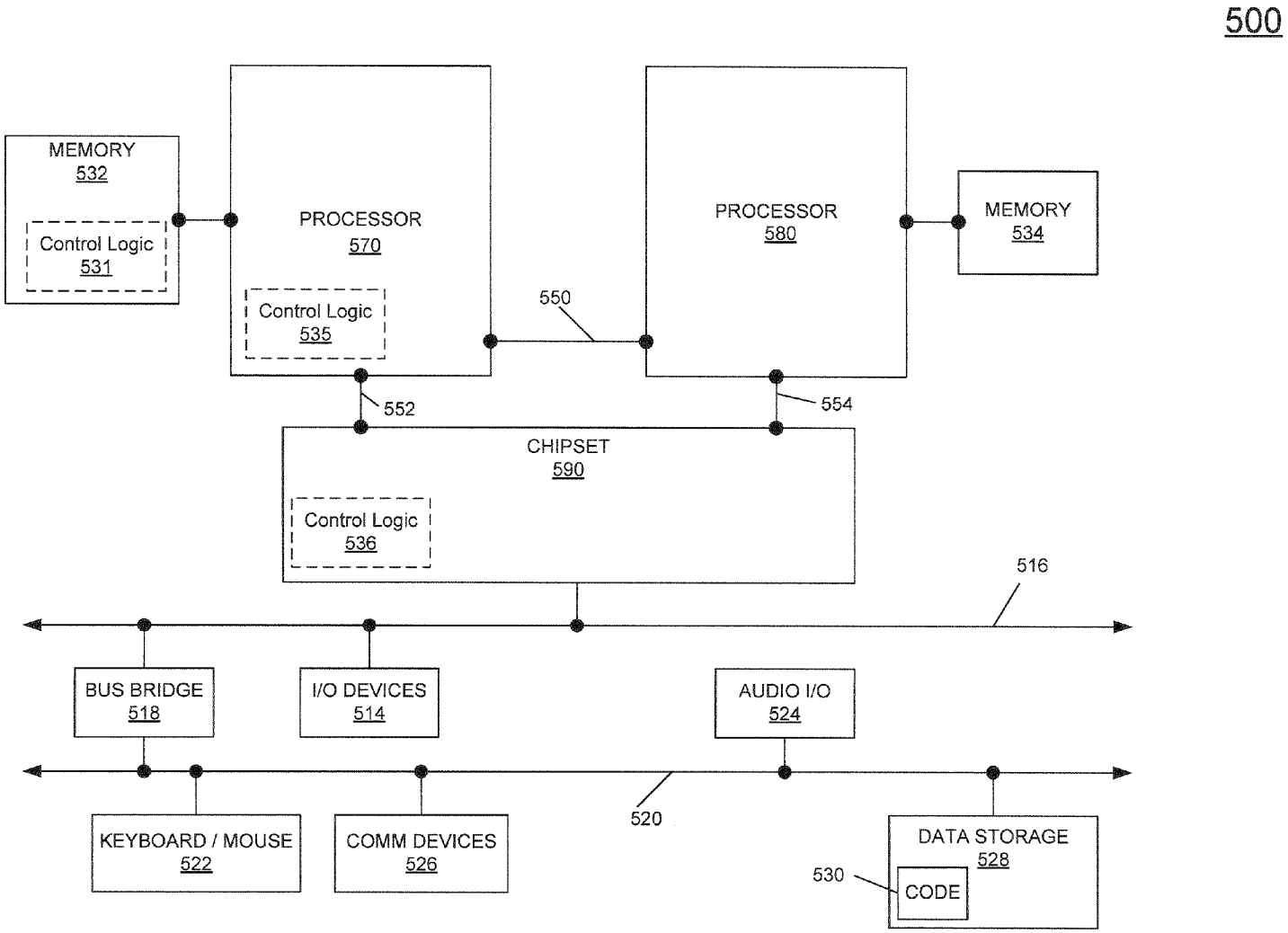
FIG. 5 includes a system for operation within or with embodiments of the invention.

Embodiments may be implemented in many different system types. Referring now to FIG. 5, shown is a block diagram of a system in accordance with an embodiment of the present invention. Multiprocessor system 500 is a point-to-point interconnect system, and includes a first processor 570 and a second processor 580 coupled via a point-to-point interconnect 550. System 500 may be included in node 135 (e.g., server, laptop, notebook, tablet, cell phone, Smartphone, desktop, mobile communications node, and the like), VM 100, and the like. Each of processors 570 and 580 may be multicore processors. The term "processor" may refer to any device or portion of a device that processes electronic data from registers and/or memory to transform that electronic data into other electronic data that may be stored in registers and/or memory. First processor 570 may include a memory controller hub (MCH) and point-to-point (P-P) interfaces. Similarly, second processor 580 may include a MCH and P-P interfaces. The MCHs may couple the processors to respective memories, namely memory 532 and memory 534, which may be portions of main memory (e.g., a dynamic random access memory (DRAM)) locally attached to the respective processors. First processor 570 and second processor 580 may be coupled to a chipset 590 via P-P interconnects, respectively. Chipset 590 may include P-P interfaces. Furthermore, chipset 590 may be coupled to a first bus 516 via an interface. Various input/output (I/O) devices 514 may be coupled to first bus 516, along with a bus bridge 518, which couples first bus 516 to a second bus 520. Various devices may be coupled to second bus 520 including, for example, a keyboard/mouse 522, communication devices 526, and data storage unit 528 such as a disk drive or other mass storage device, which may include code 530, in one embodiment. Code may be included in one or more memories including memory 528, 532, 534, memory coupled to system 500 via a network, and the like. Further, an audio I/O 524 may be coupled to second bus 520.

Embodiments may be implemented in code and may be stored on storage medium having stored thereon instructions which can be used to program a system to perform the instructions. The storage medium may include, but is not limited to, any type of disk including floppy disks, optical disks, solid state drives (SSDs), compact disk read-only memories (CD-ROMs), compact disk rewritables (CD-RWs), and magneto-optical disks, semiconductor devices such as read-only memories (ROMs), random access memories (RAMs) such as dynamic random access memories (DRAMs), static random access memories (SRAMs), erasable programmable read-only memories (EPROMs), flash memories, electrically erasable programmable read-only memories (EEPROMs), magnetic or optical cards, or any other type of media suitable for storing electronic instructions.

Embodiments of the invention may be described herein with reference to data such as instructions, functions, procedures, data structures, application programs, configuration settings, code, and the like. When the data is accessed by a machine, the machine may respond by performing tasks, defining abstract data types, establishing low-level hardware contexts, and/or performing other operations, as described in greater detail herein. The data may be stored in volatile and/or non-volatile data storage. The terms "code" or "program" cover a broad range of components and constructs, including applications, drivers, processes, routines, methods, modules, and subprograms and may refer to any collection of instructions which, when executed by a processing system, performs a desired operation or operations. In addition, alternative embodiments may include processes that use fewer than all of the disclosed operations, processes that use additional operations, processes that use the same operations in a different sequence, and processes in which the individual operations disclosed herein are combined, subdivided, or otherwise altered. In one embodiment, use of the term control logic includes hardware, such as transistors, registers, or other hardware, such as programmable logic devices (535). However, in another embodiment, logic also includes software or code (531). Such logic may be integrated with hardware, such as firmware or micro-code (536). A processor or controller (e.g., VMCC 105) may include control logic intended to represent any of a wide variety of control logic known in the art and, as such, may well be implemented as a microprocessor, a micro-controller, a field-programmable gate array (FPGA), application specific integrated circuit (ASIC), programmable logic device (PLD) and the like. In some implementations, controller 105, 115 and the like are intended to represent content (e.g., software instructions, etc.), which when executed implements the features described herein FIG. 6 includes a circuit schematic in an embodiment of the invention. Circuit 600 could be used in or coupled to DSIC 140. In circuit 600, VIU 115 would couple to circuit 600 via the following signals: PWR=power from the VIU 115 to drive circuit 600, GND=power and signal ground reference, SENSE=input to VIU 115 to sense the current open/closed status of door switch (e.g., switch 110 and/or switch 125), PULSE=binary output to control the signal that VMCC 105 senses. In circuit 600, VMCC 105 would couple to circuit 600 via the following signals: MACH=the sense input that couples circuit 600 to VMCC 105, NC=a switch pole for the normally-closed actual door switch that couples a switch (e.g., sensor 110) to circuit 600 (normally closed indicates an embodiment that is normally high (binary 1) in the closed door state and goes low (binary 0 or ground) when the door is opened), COM=common or ground reference for VMCC.

In an embodiment, reed-relay 605 serves to remove the interrupter from the circuit when VIU 115 power is lost. This allows for normal operation when the VIU has no power. When power is applied, the relay throws and VIU 115 is inserted into the circuit. U1 (opto-isolator) and D1 serve as isolation devices which prevent current flowing from the VMCC 105 to VIU 115.

DOOR PHYSICALLY CLOSED MODE: In normal operation with the VM door closed, the PULSE output is held high and the NC switch is also normally high. This causes the base of Q1 to rise and therefore Q1 becomes forward biased and switches on. This allows current to flow through the LED in U1 and turn on the transistor in U1. Current flowing through the transistor in U1 increases the voltage across R4 such that the base of Q2 is lowered to the point that it switches off. This is seen by VMCC 105 as a high-impedance or open circuit just as a switch open (door closed) would appear. Also in this state, when the collector of Q1 starts conducting, D2 becomes forward biased and the SENSE input of VIU 115 is pulled low such that VIU 115 also sees the door closed.

DOOR PHYSICALLY OPENED MODE: When the system is in the DOOR PHYSICALLY CLOSED MODE described above (the door is physically closed) and then the actual door is opened, the NC signal goes from high to low. This causes D3 to become forward-biased and conduct which pulls enough current through R1 that the base of Q1 is held low and Q1 does not conduct. This stops current through the LED in U1 and therefore the transistor in U1 is not conducting. This allows R4 to rise enough such that the base of Q2 becomes forward biased and Q2 switches on. This pulls the MACH input to ground and VMCC 105 sees the low state just as if it was sensing the actual switch closure (open door).

DOOR SIMULATED AS BEING OPEN MODE: When the system is in the DOOR PHYSICALLY CLOSED MODE described above (the door is physically closed) and VIU 115 wishes to simulate a door open, the PULSE output is lowered to zero. Just as above in the DOOR PHYSICALLY OPENED MODE, this causes D3 to be reverse biased and Q1 to switch off. VMCC 105 "sees" a switch closure (open door) without the actual switch changing state.

Figure 6:
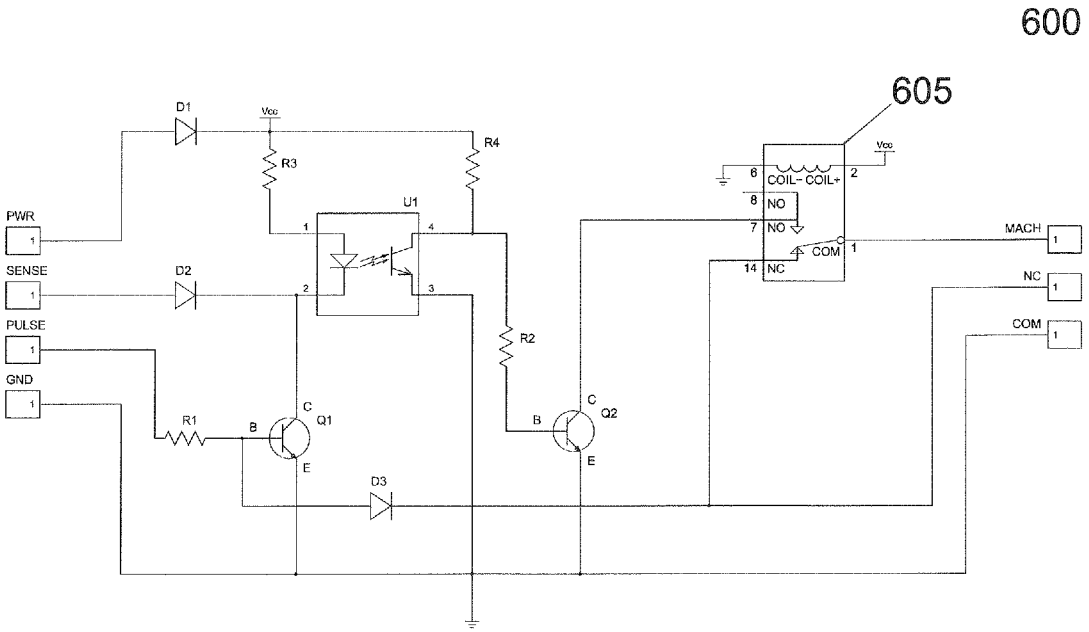
FIG. 6 includes a circuit schematic in an embodiment of the invention.
Figure 7:
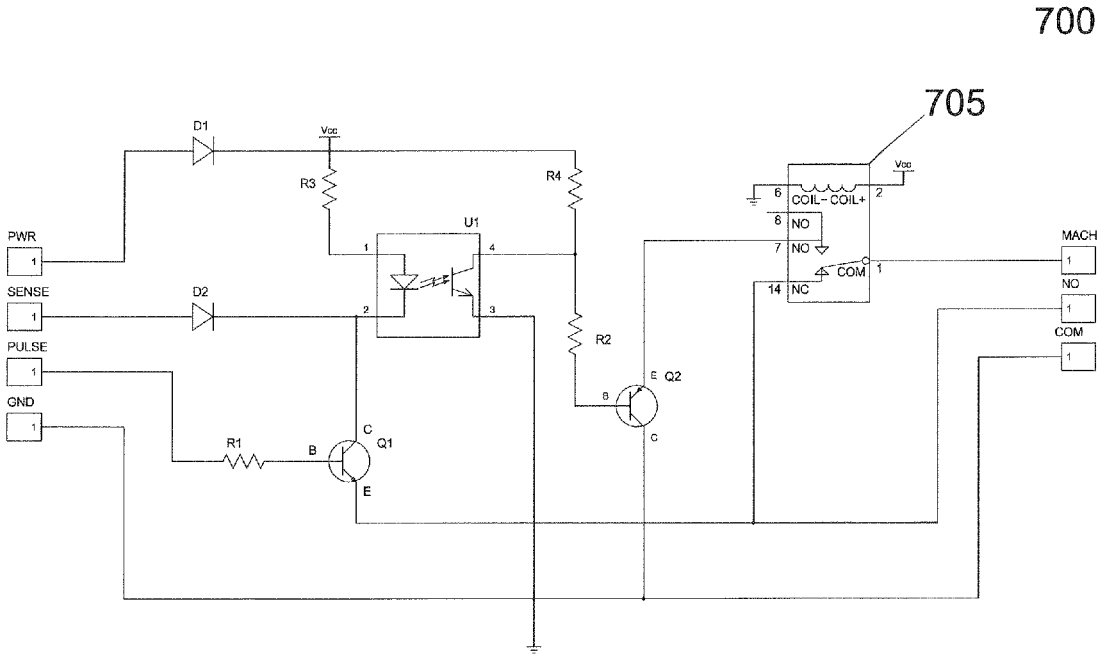
FIG. 7 includes a circuit schematic in an embodiment of the invention.

For FIG. 7, the signals are the same as FIG. 6 except for the NO signal (which is normally low or grounded when the door is closed and goes high when the door is opened) instead of the NC signal for VMCC 105. Circuit 700 could be used in or coupled to DSIC 140.

DOOR PHYSICALLY CLOSED MODE: In normal operation with door closed, PULSE is held HIGH and the NO signal is low at ground. This effectively grounds the emitter of Q1 allowing Q1 to switch on. This allows current to drive the LED and to switch on the transistor in U1. The current through the transistor in U1 increases the voltage across R4 which lowers the base of the PNP transistor Q2 which allows it to switch on. Q2 turning on effectively grounds the MACH input and the VMCC senses the switch closed state.

DOOR PHYSICALLY OPENED MODE: In the DOOR PHYSICALLY CLOSED MODE, when the door is opened the emitter of Q1 no longer has a path to ground and therefore switches off. This stops current through the LED in U1 and turns off the transistor in U1. This loss of current reduces the voltage across R4 and raises the base of Q2. Q2 switches off and the VMCC senses a high impedance or open-circuit (open door).

DOOR SIMULATED AS BEING OPEN MODE: When the system is in the DOOR PHYSICALLY CLOSED MODE described above (the door is physically closed) and VIU 115 wishes to simulate a door open state, the PULSE signal is forced low, this lowers the base of Q1 and Q1 switches off. Just as above, this eventually switches off Q2 and the VMCC "sees" the door switch change state (open door).

In an embodiment no door sensor is necessary. For example, FIG. 2 may be modified such that door sensor 110 is excluded. In such an instance control of DSIC 140 could produce an enabling signal (so that VMCC 105 is acceptable to new instructions) regardless of whether a door sensor even exists, or even a door. For example, in some embodiments the VM may not include a door, much less require a door to be open in order for instructions to be received.

Further, FIGS. 6 and 7 discuss various instances where a circuit or switch may be normally "HI", "LO", "Open", "Closed" and the like however embodiments are not limited to any initial condition or state.

A module as used herein refers to any hardware, software, firmware, or a combination thereof. Often module boundaries (e.g., module 105, 115) that are illustrated as separate commonly vary and potentially overlap. For example, a first module and a second module may share hardware, software, firmware, or a combination thereof, while potentially retaining some independent hardware, software, or firmware. A control logic module may include VMCC 105, VIU 115, and DSIC 140 and/or sensor 110 and/or sensor 125 in separate packages or same packages.

An embodiment includes a vending machine comprising: a door; an inner compartment, coupled to the door, including at least one processor (e.g., VMCC 105 included in a module or distributed among several modules) and inventory space for vending products (e.g., cans of soda); a sensor (e.g., sensors 110, 125), coupled to the door, to determine when the door is open; a transceiver; and control logic (e.g., software and/or hardware in a module or distributed among several modules), coupled to the transceiver and at least one memory and including the sensor, to (a) receive instructions from a computing node, external to the vending machine, and store the instructions in the at least one memory; (b) communicate an open state signal to the at least one processor, the open state signal corresponding to a status of the door being open; and (c) communicate the instructions to the at least one processor in response to communicating the open state signal to the at least one processor; wherein the at least one processor is securely configured to accept the instructions in response to an indication that the door is open. An embodiment includes an additional sensor, coupled to the door, to detect when the door is open and to communicate an open state signal, corresponding to detecting when the door is open, to the control logic. In an embodiment the control logic is to communicate the open state signal to the at least one processor; and communicate the instructions to the at least one processor in response to the additional sensor detecting when the door is open. In an embodiment the control logic is to communicate the open state signal to the at least one processor independently of the sensor determining when the door is open. In an embodiment the control logic is to communicate the open state signal to the at least one processor when the door is closed. In an embodiment the control logic is to communicate the open state signal to the at least one processor in response to receiving the instructions from the computing node. For example, the open state signal may be issued (immediately or after a delay) once a system determines there are new instructions to load. In an embodiment the at least one processor is securely configured to accept the instructions only in response to an indication that the door is open and to reject the instructions in response to an indication that the door is closed. Such a rejection may include storing instructions in a memory but not displacing older instructions with similar newer instructions. In an embodiment the control logic is to store the instructions in the at least one memory when the door is closed and before communicating the open state signal to the at least one processor. In an embodiment the sensor couples to the at least one processor via a first route and the control logic communicates the open state signal to the at least one processor via the first route. In an embodiment the instructions correspond to at least one of a sales price, an inventory level, and energy conservation.

An embodiment includes control logic, to couple to a transceiver of a vending machine (VM), at least one memory, and a sensor to couple to a door of the VM and determine when the door is open, the control logic to: (a) receive instructions from a computing node, external to the VM, and store the instructions in the at least one memory; (b) communicate an open state signal to at least one processor included in the VM, the open state signal corresponding to a status of the door being open; and (c) communicate the instructions to the at least one processor in response to communicating the open state signal to the at least one processor; wherein the at least one processor is securely configured to accept the instructions in response to an indication that the door is open. Thus, an embodiment may include a component that may be added to a new or preexisting (already deployed in the field) VM that is being upgraded. An embodiment may include an additional sensor, to couple to the door, to detect when the door is open and to communicate an open state signal, corresponding to detecting when the door is open, to the control logic. In and embodiment the control logic is to communicate the open state signal to the at least one processor; and communicate the instructions to the at least one processor in response to the additional sensor detecting when the door is open. In and embodiment the control logic is to communicate the open state signal to the at least one processor independently of the sensor determining when the door is open. In an embodiment the control logic is to communicate the open state signal to the at least one processor when the door is closed. In an embodiment the control logic is to communicate the open state signal to the at least one processor in response to receiving the instructions from the computing node. In and embodiment the at least one processor is securely configured to accept the instructions only in response to an indication that the door is open and to reject the instructions in response to an indication that the door is closed. (a) the control logic is to communicate the open state signal to the at least one processor in response to the sensor determining when the door is open, and (b) the sensor is to couple to the at least one processor via a first route and the control logic communicates the open state signal to the at least one processor via a second route. In an embodiment the control logic is to store the instructions in the at least one memory when the door is closed and before communicating the open state signal to the at least one processor. In and embodiment the sensor is to couple to the at least one processor via a first route and the control logic communicates the open state signal to the at least one processor via the first route. In and embodiment the instructions correspond to at least one of a sales price, an inventory level, and energy conservation. In and embodiment the at least one processor is securely configured to only accept the instructions in response to an indication that the door is open and the sensor is included in the control logic.

An embodiment includes a system comprising: control logic, to couple to a transceiver of a vending machine (VM), at least one memory, and at least one controller included in the VM, the control logic to: (a) receive instructions from a computing node, external to the VM, and store the instructions in the at least one memory; (b) receive a first enablement communication from one of the computing node and an additional computing node that is external to the VM; (c) communicate a second enablement communication to the at least one controller in response to receiving the first enablement communication; and (d) communicate the instructions to the at least one controller in response to communicating the second enablement signal to the at least one controller; wherein the at least one controller is securely configured to accept the instructions only in response to receiving the second enablement signal. Thus, an embodiment may receive a signal (e.g., a near field communication from a nearby technician standing close to the VM) that indicates a programming is safe an appropriate for the controller. The communication may be secure and traceable to a reliable source based on security certificates and encryption mechanisms (e.g., symmetric or asymmetric keys). Based on receiving the signal or communication (e.g., a digital or analog signal, an instruction, a data packet, and the like) logic may send further communications to the controller (or controllers) to configure itself to receive instructions. In an embodiment the control logic is to communicate the second enablement communication to the at least one controller when a door of the VM is closed, the door providing access to inventory to be included in the VM. In and embodiment the control logic is to communicate the second enablement communication to the at least one controller when a door of the VM is open, the door providing access to inventory to be included in the VM.

An embodiment includes a system comprising: control logic to (a) couple to at least one controller included in a vending machine (VM); (b) receive a first enablement communication from one of a computing node external to the VM and sensor logic that determines a door of the VM is open; and (c) communicate a second enablement communication to the at least one controller in response to receiving the first enablement communication; wherein the at least one controller is securely configured to accept configuration instructions only in response to receiving the second enablement communication. Thus, an embodiment may concern itself more with communicating instruction acceptance enabling signals and not concern itself with conveyance of the programmable instructions themselves (e.g., instructions conveyed via interconnect 112). In an embodiment the control logic is to communicate the second enablement communication to the at least one controller when the door of the VM is closed.

An embodiment includes a system comprising: control logic, to couple to a transceiver of a vending machine (VM), at least one memory, at least one controller included in the VM, and additional control logic; wherein (a) the additional control logic is to receive instructions from a computing node, external to the VM, and store the instructions in the at least one memory; (b) the control logic is to receive a first enablement communication from one of the computing node and an additional computing node that is external to the VM; (c) the control logic is to communicate a second enablement communication to the at least one controller in response to receiving the first enablement communication; (d) the additional control logic is to communicate the instructions to the at least one controller in response to communicating the second enablement signal to the at least one controller; and (e) the at least one controller is securely configured to accept the instructions only in response to receiving the second enablement signal. In an embodiment the control logic is included in the DSIC and any related software or hardware in the same module as the DSIC or external to any DSIC module (e.g., in a portion of the VIU) and the additional logic is included in, for example, the VIU (e.g., another portion of the VIU). In another embodiment the control logic includes sensor 125 and related software or hardware in the same module or external thereto (e.g., in a portion of the VIU or located outside sensor 125 and VIU) and the additional logic is included in, for example, the VIU (e.g., another portion of the VIU) or external to the VIU and sensor 125.

While the present invention has been described with respect to a limited number of embodiments, those skilled in the art will appreciate numerous modifications and variations therefrom. It is intended that the appended claims cover all such modifications and variations as fall within the true spirit and scope of this present invention.

What is claimed is:

1. A vending machine comprising:

a door;

an inner compartment, coupled to the door, including at least one processor and inventory space for vending products;

a sensor, coupled to the door, to determine when the door is open;

a transceiver; and control logic, coupled to the transceiver and at least one memory and including the sensor, to (a) receive instructions from a computing node, external to the vending machine, and store the instructions in the at least one memory; (b) communicate an open state signal to the at least one processor, the open state signal corresponding to a status of the door being open; and (c) communicate the instructions to the at least one processor in response to communicating the open state signal to the at least one processor;

wherein the at least one processor is securely configured to accept the instructions in response to an indication that the door is open;

wherein the control logic is to communicate the open state signal to the at least one processor when the door is closed.

2. The vending machine of claim 1 comprising an additional sensor, coupled to the door, to detect when the door is open and to communicate an open state signal, corresponding to detecting when the door is open, to the control logic.

3. The vending machine of claim 2, wherein the control logic is to communicate the open state signal to the at least one processor and communicate the instructions to the at least one processor in response to the additional sensor detecting when the door is open.

4. The vending machine of claim 1 wherein the control logic is to communicate the open state signal to the at least one processor independently of the sensor determining when the door is open.

5. The vending machine of claim 1, wherein the control logic is to communicate the open state signal to the at least one processor in response to receiving the instructions from the computing node.

6. The vending machine of claim 1 wherein the at least one processor is securely configured to accept the instructions only in response to an indication that the door is open and to reject the instructions in response to an indication that the door is closed.

7. The vending machine of claim 1 wherein the control logic is to store the instructions in the at least one memory when the door is closed and before communicating the open state signal to the at least one processor.

8. The vending machine of claim 1 wherein the sensor couples to the at least one processor via a first route and the control logic communicates the open state signal to the at least one processor via the first route.

9. The vending machine of claim 1 wherein the instructions correspond to at least one of a sales price, an inventory level, and energy conservation.

10. A system comprising:

control logic, to couple to a transceiver of a vending machine (VM), at least one memory, and a sensor to couple to a door of the VM and determine when the door is open, the control logic to: (a) receive instructions from a computing node, external to the VM, and store the instructions in the at least one memory; (b) communicate an open state signal to at least one processor included in the VM, the open state signal corresponding to a status of the door being open; and (c) communicate the instructions to the at least one processor in response to communicating the open state signal to the at least one processor;

wherein the at least one processor is securely configured to accept the instructions in response to an indication that the door is open;

wherein the control logic is to communicate the open state signal to the at least one processor when the door is closed.

11. The system of claim 10 comprising an additional sensor, to couple to the door, to detect when the door is open and to communicate an open state signal, corresponding to detecting when the door is open, to the control logic.

12. The system of claim 11, wherein the control logic is to communicate the open state signal to the at least one processor; and communicate the instructions to the at least one processor in response to the additional sensor detecting when the door is open.

13. The system of claim 10 wherein the control logic is to communicate the open state signal to the at least one processor independently of the sensor determining when the door is open.

14. The system of claim 10 wherein the at least one processor is securely configured to accept the instructions only in response to an indication that the door is open and to reject the instructions in response to an indication that the door is closed.

15. The system of claim 10 wherein the control logic is to store the instructions in the at least one memory when the door is closed and before communicating the open state signal to the at least one processor.

16. The system of claim 10 wherein the sensor is to couple to the at least one processor via a first route and the control logic communicates the open state signal to the at least one processor via the first route.

17. The system of claim 10 wherein the instructions correspond to at least one of a sales price, an inventory level, and energy conservation.

18. The system of claim 10, wherein the at least one processor is securely configured to only accept the instructions in response to an indication that the door is open and the sensor is included in the control logic.

19. A vending machine comprising:

a door;

an inner compartment, coupled to the door, including at least one processor and inventory space for vending products;

a sensor, coupled to the door, to determine when the door is open;

a transceiver; and control logic, coupled to the transceiver and at least one memory and including the sensor, to (a) receive instructions from a computing node, external to the vending machine, and store the instructions in the at least one memory; (b) communicate an open state signal to the at least one processor, the open state signal corresponding to a status of the door being open; and (c) communicate the instructions to the at least one processor in response to communicating the open state signal to the at least one processor;

wherein the at least one processor is securely configured to accept the instructions in response to an indication that the door is open;

wherein the control logic is to communicate the open state signal to the at least one processor independently of the sensor determining when the door is open.

20. The vending machine of claim 19, wherein the control logic is to communicate the open state signal to the at least one processor in response to receiving the instructions from the computing node.

21. The vending machine of claim 19, wherein the at least one processor is securely configured to accept the instructions only in response to an indication that the door is open and to reject the instructions in response to an indication that the door is closed.

22. The vending machine of claim 19, wherein the control logic is to store the instructions in the at least one memory when the door is closed and before communicating the open state signal to the at least one processor.

23. The vending machine of claim 19, wherein the sensor couples to the at least one processor via a first route and the control logic communicates the open state signal to the at least one processor via the first route.

24. The vending machine of claim 19, wherein the instructions correspond to at least one of a sales price, an inventory level, and energy conservation.

25. A system comprising:

control logic, to couple to a transceiver of a vending machine (VM), at least one memory, and a sensor to couple to a door of the VM and determine when the door is open, the control logic to: (a) receive instructions from a computing node, external to the VM, and store the instructions in the at least one memory; (b) communicate an open state signal to at least one processor included in the VM, the open state signal corresponding to a status of the door being open; and (c) communicate the instructions to the at least one processor in response to communicating the open state signal to the at least one processor;

wherein the at least one processor is securely configured to accept the instructions in response to an indication that the door is open;

wherein the control logic is to communicate the open state signal to the at least one processor independently of the sensor determining when the door is open.

26. The system of claim 25 wherein the at least one processor is securely configured to accept the instructions only in response to an indication that the door is open and to reject the instructions in response to an indication that the door is closed.

27. The system of claim 25 wherein the control logic is to store the instructions in the at least one memory when the door is closed and before communicating the open state signal to the at least one processor.

28. The system of claim 25 wherein the sensor is to couple to the at least one processor via a first route and the control logic communicates the open state signal to the at least one processor via the first route.

29. The system of claim 25 wherein the instructions correspond to at least one of a sales price, an inventory level, and energy conservation.

30. The system of claim 25, wherein the at least one processor is securely configured to only accept the instructions in response to an indication that the door is open and the sensor is included in the control logic.

* * * * *